United States Patent [19]

Hagopian

[11] 4,079,972

[45] Mar. 21, 1978

[54] PORTABLE DOOR BAR

[76] Inventor: Wayne N. Hagopian, 93 Crescent Ave., Cliffside Park, N.J. 07010

[21] Appl. No.: 611,893

[22] Filed: Sep. 10, 1975

[51] Int. Cl.[2] ..... E05C 17/30

[52] U.S. Cl. ..... 292/259 R

[58] Field of Search ..... 292/259, 260, 263, 262

[56] References Cited

U.S. PATENT DOCUMENTS

| | | | |
|---|---|---|---|
| 3,206,793 | 9/1965 | Silverberg | 16/137 |
| 3,451,708 | 6/1969 | Brooks | 292/264 |
| 3,809,417 | 5/1974 | Craig | 292/259 |

*Primary Examiner*—Richard E. Moore

*Attorney, Agent, or Firm*—Constantine A. Michalos

[57] ABSTRACT

Portable door bar comprising a telescopic rod having a loop at one end for insertion around a door knob and a spacer at the other end for contacting a wall adjacent to a closed door. The telescopic rod being threaded through a ring chain which is first slipped through one of the door's hinges. The spacer being of variable thickness so as to jam the rod end in position for positive contacting relation with the door and the wall.

7 Claims, 5 Drawing Figures

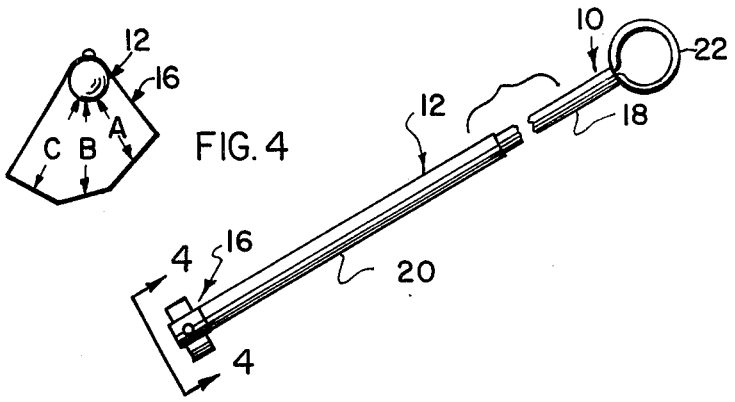
FIG. 4
FIG. 1
FIG. 2
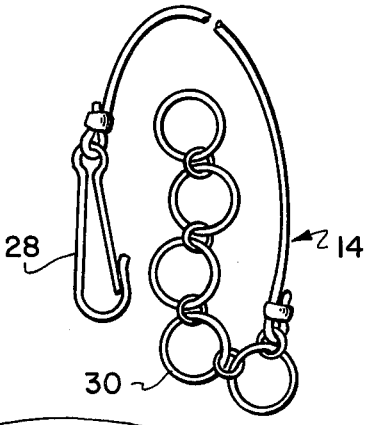
FIG. 3
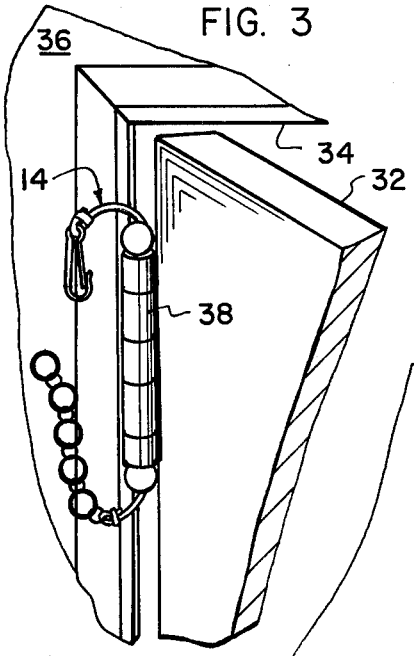
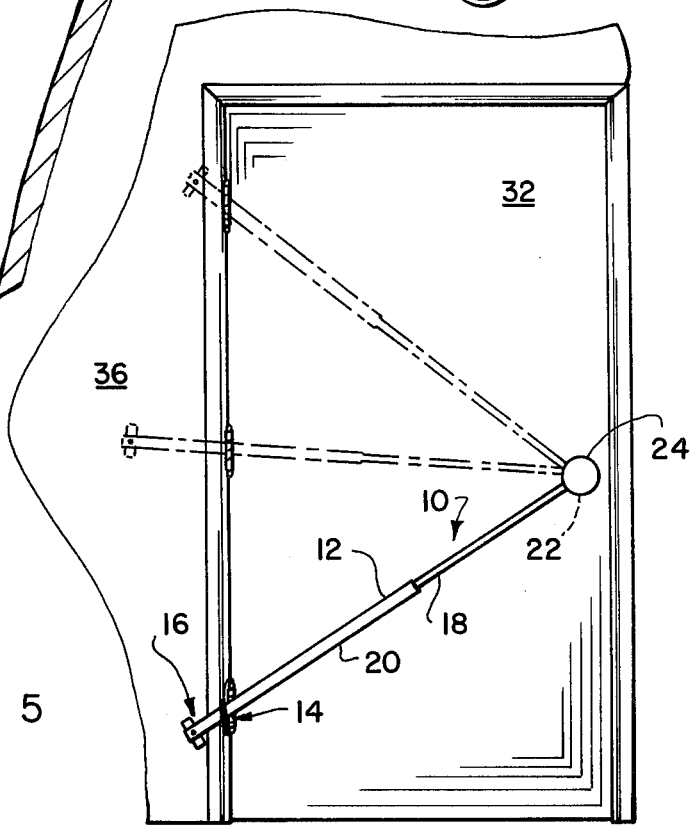
FIG. 5

PORTABLE DOOR BAR

BACKGROUND OF THE INVENTION

1. Field of the Invention

In general, the present invention is related to door locking devices. More particularly, this invention is concerned with a portable door bar for positively locking a door from inside a room and which lock is independent from any other locking means so as to more positively protect the occupant of a room against outside intruders.

2. Description of Prior Art

Heretofore, conventional safety devices or door fasteners were used whereby the door fasteners were small insignificant locking mechanisms.

In the present days of mass burglarization of every type it is of public concern to protect oneself within the confines of one's private home or a motel room. There is a need for a more effective way of keeping outside intruders from breaking and entering the individual's private confinement.

Heretofore there were several safety devices such as latches, small fasteners of stamped metal and other securing devices. Most of these securing devices concentrated around the door's lock area and have not done the job satisfactorily. The intruder could use burglarizing instruments inserted into the room between the door frame and the door to unlatch the safety devices and enter the room. Other archaic devices were used for double locking the doors but did not solve the problem of preventing the breaking and entering of motel rooms or private homes. In order to prevent this breaking and entering this invention provides for a cross bracing concept of bridging the door horizontally or diagonally by means of a reinforced bar or beam that could be only removed by someone within the room.

The present invention therefore contemplates a large overall locking device which bridges the door from the door knob and extending across the door to include a portion of the wall area. This bridging or cross bracing of the door produces a more secured and rigid locking concept.

The present invention therefore resolves the problem of breaking and entering to a large extent, by providing a portable door bar which presents a positive cross-braced holding device which cannot be broken or be singularly manipulated and removed by small tools inserted from the outside and through the door and door jam. The only way that this portable door bar can be unlocked may be by completely destroying or removing the door which of course is impractical since the intruder will be spotted by any passerby.

SUMMARY

The present invention contemplates a portable door bar for rapid assembling, bracing and locking the inside of the door to protect the occupants within the confines of the inner part of the room. The invention provides for a portable door bar for security in hotel room doors or private home doors of a temporary or permanent nature. The portable door bar can be adjusted to fit into a suit case which may be carried by the owner from hotel to hotel and which can be readily extended to use as a door securing means against outside intruders.

The portable door bar is attached at one end to a door knob by a connecting ring, threaded through a ring chain, which in turn had been inserted around one door hing and is then extended through this ring chain to a connecting brace or spacer which contacts a wall portion next to the door. The brace or spacer is used to take up the space which has been produced by the hinge protruding from the wall and door surface. The brace therefore produces a contacting relationship of the door surface at one end and the wall surface at the other end.

Therefore a primary object of this invention is to provide for a portable door bar for use as a safety door securing device to inhibit unauthorized entrance which can be retracted so it can fit in a suit case and which can be extended to bridge across the whole door from the door knob across the door horizontally or diagonally for contacting the wall area and thereby accomplish a positive contacting relationship.

Another object of this invention is to provide for a portable door bar that can be rapidly assembled and used as a safety device to temporarily or more permanently secure a door of a motel or private house to protect the occupants against outside intruders.

Still another object of the invention is to provide for a portable door bar safety device which contemplates a wedging action causing positive contacting relationship of the door and wall area thereby providing for a safety device in addition to the lock to inhibit the opening of the door by outside intruders.

Still another object of this invention is to provide for a safety device which is of minimum complexity to a point where a child can utilize it and can lock the door from the inside to prevent any outside unauthorized intruders.

A further object of this invention is to provide for a portable door bar having improved means of securing a door against outside intruders utilizing minimum number of parts and is economical to manufacture.

These and other objects and features of the invention are pointed out in the following descriptions in terms of the embodiments thereof which are shown in the accompanying drawing. It is to be understood however, that the drawing is for the purpose of illustration only and are not a definition of the limits of the invention.

BRIEF DESCRIPTION OF THE DRAWING

FIG. 1 is an elevational view of one part of the portable door bar.

FIG. 2 is an elevational view of a second part of the invention.

FIG. 3 is a fragmentary view of the door and its hinge clearly showing the relation of the part of the invention of FIG. 2 in a partially assembled position.

FIG. 4 is a view taken along line 4—4 of FIG. 1 showing another element of the invention such as the spacer or brace wedge.

FIG. 5 is the portable door bar as completely assembled in a secured position. The PHANTOM lines showing two other positions that the portable door bar may be used to secure the door from entry of unauthorized outside intruders.

DESCRIPTION OF THE PREFERRED EMBODIMENT OF THE INVENTION

Referring to the drawing a portable door bar 10 is basically comprised of a telescopic bar 12, a ring chain 14, and a spacer or brace wedge 16. The space 16 is utilized to fill in the space which is caused by the hinge which extends beyond the door and wall surface. As shown in FIG. 4 the spacer 16 is shown with three surfaces a distance of A, B, and C away from the telescopic bar 12. It is understood that any number of surfaces can be utilized on the spacer or brace and being of different distances from the bar 12 to provide more number of adjustments.

The telescopic bar or cross-bracing means 12 comprises a rod 18 which is axially insertable in a tube 20. The rod 12 can therefore be adjusted and reduced in size to be more readily packed in a suit case and thereby be carried from motel to motel when the owner is traveling. In this respect the owner can utilize it temporarily to secure himself within each motel room. The rod 12 comprises at one end the brace 16 as one connecting means and at its other end a second connecting means or ring 22 that can be fabricated of nylon cord or unbreakable wire. The ring 22 can be of a size that can be connected to a door by being looped about a door knob 24, shown in FIG. 5.

The ring chain 14 which is a third connecting means comprises a flexible member 26 which also can be made of nylon cord or unbreakable wire, a hook or clip 28 at one end and a plurality of interconnected-sapced metal rings 30.

The portable door bar 10 is shown in FIGS. 3 and 5 as it is operably attached to a door 32 having a frame 34 which in turn is connected to a wall 36. The ring 14 is first inserted through a door hinge 38 of the door 32 when the door is in an open position, as shown in FIG. 3. The door 32 is then closed as shown in FIG. 5 and the clip 28 is connected to one of the rings 30 to form a loop. The ring 22 is then placed circumferentially around the door knob 24 and the rod 10 extended through the loop formed by the ring chain 14 and as far as practical to a point where it contacts a surface of the wall 36 by its spacer 16. The spacer 16 is wedged between the wall 36 and the tube 20 of the rod 10 causing a wedging action for a positive contact of the portable bar 10 the door 32 and the wall 36.

It may be desirable to attach the portable door bar 10 in the diagonal position shown in solid lines in FIG. 5, in a horizontal position shown in phantom lines in FIG. 5 or in a diagonal position having the spacer 16 in an opermont location also shown in phantom lines in FIG. 5. In any respect the door cannot be open from the outside by a key or by any other way from the outside al long as the portable door bar is in position. The portable door bar 10 therefore provides for a securing action which bridges the door and wall area of a hotel, motel, or private home. This portable door bar provides security in hotel or homes which can be of a temporary nature depending on the wish of the occupant of the room. It can be readily removed from the inside to open the door. As brought out before it is readily adjustable in size so that it can fit into a suitcase.

While the present invention has been described in preferred embodiments, it will be obvious to those skilled in the art that various modifications can be made therein within the scope of the invention.

What is claimed is:

1. A portable door bar for use as a safety securing device for a door in a hotel or home the door having a doorknob and the door bar operably engaging parts of the door without disassembling any parts thereof comprising cross-bracing means having two ends and operably extending across a surface of the door, the door having two side vertical edges, a first connecting means at one end of said cross-bracing means for abutting a wall surface adjacent the door at one side vertical edge of the door, a second connecting means at the other end of said cross-bracing means operably connecting the doorknob at the opposite vertical edge of the door between the wall surface and said second mentioned side vertical edge of the door whereby the door is bridged in such a manner as to operably prevent opening thereof by an outside intruder.

2. The apparatus of claim 1 wherein said cross-bracing means is comprised of a rod integral to one end of the door bar and a tube having an aperture extending longitudinally thereof for receiving said rod, said rod integral to the other end of the door bar said bar being compacted within said tube for fitting within a suitcase.

3. The apparatus according to claim 1 wherein said one connecting means is a ring at one end of said cross-bracing means to be operably looped about the door knob and thereby connect the same.

4. The structure of claim 3 further comprising a third connecting means said third means including a ring chain operably looped around a door hinge forming a loop wherein the rod of said portable door bar is threaded.

5. The structure of claim 3 further comprising a fourth connecting means said fourth means including a flexible member for insertion around a door hinge, a plurality of interconnected-spaced rings at one end of said flexible member and a clip at the other end of said flexible member operably connecting one of the rings of said plurality of rings for said fourth connecting means forming a desired sized loop.

6. The structure of claim 4 wherein said first connecting means is a brace wedge used as a spacer operably spacing said cross-bracing means for positive contacting relation between the door surface and the wall surface.

7. The structure of claim 4 wherein said brace wedge includes a plurality of surfaces, each surface being of gradual increase distance from said rod for adjustment of the space between the surface of the wall and said rod to thereby provide for the positive contacting relation between said rod and the wall surface and the door surface.

* * * * *